US006222719B1

(12) United States Patent
Kadah

(10) Patent No.: US 6,222,719 B1
(45) Date of Patent: Apr. 24, 2001

(54) IGNITION BOOST AND RECTIFICATION FLAME DETECTION CIRCUIT

(76) Inventor: Andrew S. Kadah, 5000 Hennaberry Rd., Manlius, NY (US) 13104

( * ) Notice: Subject to any disclaimer, the term of this patent is extended or adjusted under 35 U.S.C. 154(b) by 0 days.

(21) Appl. No.: 09/354,538

(22) Filed: Jul. 15, 1999

(51) Int. Cl.[7] ..... F23N 5/00
(52) U.S. Cl. ..... 361/247; 361/253; 361/263
(58) Field of Search ..... 340/577–579; 431/264–266, 78; 361/247, 253, 254, 256, 257, 263, 159; 307/117

(56) References Cited

U.S. PATENT DOCUMENTS

| | | | | |
|---|---|---|---|---|
| 3,943,386 | * | 3/1976 | Simeau | 340/579 |
| 4,242,079 | * | 12/1980 | Matthews | 431/78 |
| 4,303,385 | * | 12/1981 | Rudich, Jr. et al. | 431/78 |
| 4,626,193 | * | 12/1986 | Gann | 340/579 |
| 5,074,780 | | 12/1991 | Erdman | 431/24 |
| 5,506,569 | | 4/1996 | Rowlette | 340/577 |
| 5,889,645 | | 3/1999 | Kadah et al. | 361/191 |
| 5,992,401 | * | 11/1999 | Bylsma et al. | 361/247 |

* cited by examiner

*Primary Examiner*—Fritz Fleming
(74) *Attorney, Agent, or Firm*—Bernhard P. Molldrem, Jr.

(57) ABSTRACT

A gas furnace control circuit combines an igniter circuit and a rectification flame detection circuit. Pulsating current is applied respectively to inducer and gas valve relay coils to actuate the furnace. A rectifier supplies flyback pulses from the inducer relay coil to a capacitor arrangement to accumulate flyback voltage. An ignition transformer has its secondary connected to the igniter and flame detection probe for generating an ignition arc. A hysteresis switch is coupled between the capacitor and the primary of the ignition transformer discharges current from through the primary whenever the stored flyback voltage reaches a predetermined threshold. Another capacitor is connected to the gas valve relay coil. A transistor has a signal impedance connected with its drain or power electrode to define an output terminal. A resistor network has a first resistor with one end connected to the capacitor and a its other end connected to the gate or control electrode of the transistor. A second resistor is connected between the gate and source electrodes of the transistor. The ignition transformer secondary is also connected with the first resistor, so that the igniter and flame detection probe is connected through said transformer secondary and through the first resistor to the transistor. The transistor output is in a first state if flame is present, and in a second state if flame is not present in the burner.

12 Claims, 2 Drawing Sheets

IGNITION BOOST AND RECTIFICATION FLAME DETECTION CIRCUIT

BACKGROUND OF THE INVENTION

The present invention relates to gas burners such as the type found in gas furnaces, and is more particularly concerned with means for electronically igniting the burner and for detecting or proving the existence of flame after ignition.

A number of electric igniter systems have been proposed for use with gas burners, including igniters that employ a high voltage spark, and igniters that involve a hot surface. In a mobile environment, in which the power for the furnace or heater is derived from a 12 volt DC or a 24 volt DC source, it has been common to employ a spark igniter, as heated surface type igniters have a high failure rate. The spark igniter requires some source of AC or pulsating voltage, and an inverter can be used to generate a wave which is then fed to an ignition transformer. Because of the relatively low voltage available in the mobile environment (i.e., 12 or 24 VDC), the turns ratio of the ignition transformer needs to be quite high. This means that the cost of the transformer is quite high, and also that the transformer can experience inter-turn arcing if fine wire is used in the secondary winding.

In any gas furnace it is mandatory to detect a successful ignition as a safety measure. If gas is permitted to flow to an unlit burner, explosive vapors can fill the dwelling and create a hazardous situation. Accordingly, a flame detection or flame proving means needs to be employed at the gas burner. One simple means for doing this is with a flame rectification probe. This technique is based on the fact that an active flame acts as a plasma diode. A unidirectional current can flow from a probe within the flame to the metal casing of the burner, i.e., the firebox. The flame itself thus acts like a resistance and diode connected in series. By applying an alternating current to the rectification probe, it is possible to detect the presence of flame. Rectification flame proving requires a source of alternating current, but in a mobile environment, where the power comes from 12 or 24 VDC, an inverter or other AC source has to be included in the burner control circuitry. This increases the cost of the circuitry. Moreover, the additional circuit elements increase the risk of failure.

Accordingly, a low cost ignition circuit and a flame detection circuit that would be suitable in a DC control system have been sought without success. A DC furnace control circuit that combines a burner igniter and a flame rectification probe has also been unavailable, without use of an on-board transformer.

OBJECTS AND SUMMARY OF THE INVENTION

It is an object of this invention to provide an igniter and rectification flame detection circuit which avoids the drawbacks of the prior art.

It is another object to provide a ignition circuit that employs flyback current from a furnace relay coil to develop a primary ignition current, and which permits the turns ratio of the ignition transformer to be kept relatively low.

It is a further object of the invention to provide a rectification flame detection circuit that derives an alternating current for flame detection from a furnace relay actuator coil.

It is a still further object of this invention to provide a combination burner ignition and flame proving circuit.

According to one aspect of this invention, an igniter circuit for a furnace gas burner employs a pulsating current applied to a relay coil (such as the relay actuator coil for the inducer motor) to generate high flyback voltage. A flyback rectifier has its anode connected to the relay coil and its cathode feeds flyback pulses to a charge storage capacitor arrangement, where the flyback voltage accumulates. A step-up transformer has a primary winding and a secondary winding, with the secondary winding being connected to the igniter. High voltage at the igniter causes arcing to ignite the flame in the gas burner. A hysteresis switch is coupled between the charge storage capacitor and the primary winding of the step-up transformer. When the voltage on the storage capacitor arrangement exceeds some predetermined voltage threshold, e.g., 300 volts, the stored voltage is discharged through the primary winding, and this generates the high voltage arc on the igniter probe. With this arrangement, an intermediate or booster transformer is not needed. Also, this arrangement makes it possible to use an ignition transformer with a relatively low turns ratio, which increases the reliability and reduces the cost.

The charge storage capacitor arrangement can employ only a single capacitor coupled between the diode and a point of DC reference voltage, such as ground. In a preferred embodiment, the capacitor arrangement can be configured as a voltage doubler, with a pair of capacitors and a diode connected in series between points of positive and negative DC voltage The hysteresis switch can include a controlled switching device, such as an SCR, having main electrodes, e.g., anode and cathode, connected respectively to the diode and to the primary winding of said step-up transformer. A zener device can be positioned between the gate or control electrode and one of the main electrodes of the SCR. A filter capacitor can be connected between the cathode and gate.

According to another embodiment of this invention, a rectification flame detection circuit is constructed for detecting the presence of flame in the burner of the gas furnace. Again, a pulsating current is employed, which is applied to a relay coil (e.g., the gas valve relay) in order to actuate the furnace. A capacitor has one electrode connected to the relay coil, and derives an AC voltage that is used for rectification flame detection. A detection transistor has its gate or control electrode connected through a resistive network to the flame detection conductor, a common or source electrode tied to ground, and a power or drain electrode connected via a signal impedance to a DC source. The drain and signal impedance define an output terminal therebetween. In the resistor network a first resistor has one end connected to the capacitor, its other end being connected to the control or gate electrode of said transistor. A second resistor is connected between the control electrode and common electrode, i.e., ground, of the transistor. The flame detection probe, which is located within the gas burner, is electrically connected to the capacitor and first resistor. In this arrangement, the output of the transistor oscillates between a high state and a low state, e.g., if flame is present, but remains locked in one state, i.e., the low state, if flame is not present in the burner. In a preferred embodiment, the transistor can be a depletion mode FET.

According to a further aspect of the invention, a control circuit combines a gas burner igniter circuit and a rectification flame detection circuit. There are pulsating current signals applied respectively to first and second relay coils in order to actuate the furnace. The combination igniter and flame detection circuit employs a flyback rectifier and charge storage means coupled to the flyback rectifier to accumulate flyback voltage. A step-up transformer has a primary winding and a secondary winding, with the secondary winding being connected to the igniter and flame detection probe to provide a high voltage for generating an arc for ignition. A hysteresis switch is coupled between the charge storage means and the primary winding of the step-up transformer and acts to discharge the current from the charge storage means through the primary winding whenever the stored flyback voltage reaches a predetermined threshold. There is also a capacitor connected to one end of the second relay coil. A flame detection transistor has a signal impedance connected with its drain or power electrode to define an output terminal. A resistor network has a first resistor with one end connected to the capacitor and a its other end connected to the gate or control electrode of the transistor. A second resistor is connected between the gate (control) and source (common) electrodes of the transistor. In this embodiment, one end of the ignition transformer secondary is connected to the one end of the first resistor, so that the igniter and flame detection conductor is connected through said transformer secondary and through the first resistor to the transistor. In this case, the output of the transistor terminal is oscillating if flame is present, and in a low state if flame is not present in the burner. Where the inducer relay coil is used to for generating the ignition voltage, and a microprocessor generates actuation pulses to energize the coil, the duty cycle of these pulses can be changed after ignition so as not to interfere with flame detection.

The above and many other objects, features, and advantages of this invention will present themselves to persons skilled in the art from the ensuing detailed description of a preferred embodiment of the invention, when read in conjunction with the accompanying Drawing.

DETAILED DESCRIPTION OF THE PREFERRED EMBODIMENT

Figure 1:
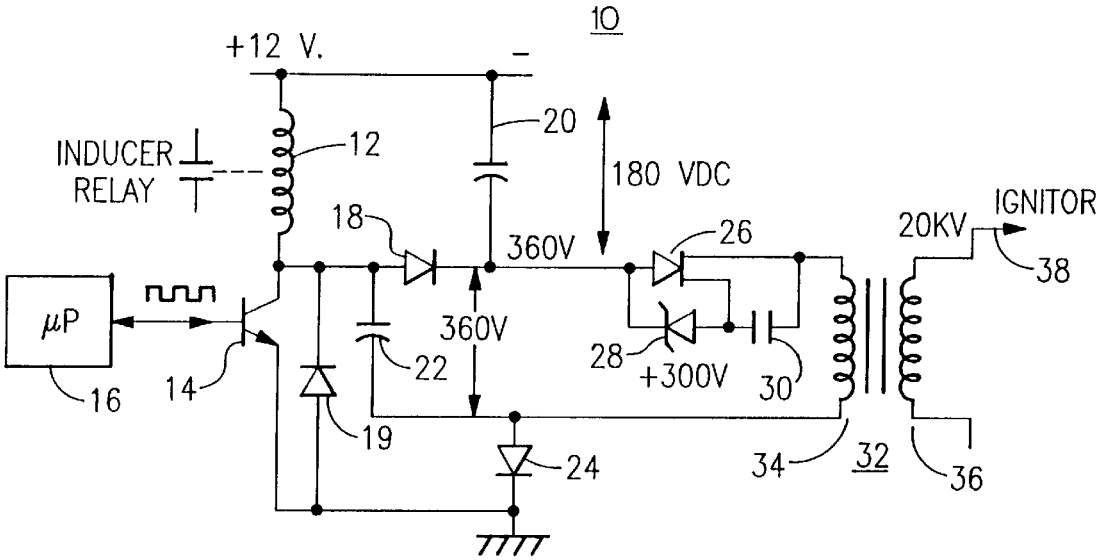
FIG. 1 is a schematic diagram of an ignition circuit according to an embodiment of this invention.

With reference to the Drawing, FIG. 1 schematically illustrates an ignition circuit 10 according to one possible embodiment of this invention. Here an inducer relay actuator coil 12 is employed for switching on an inducer motor (not shown). This coil is in series with a switching transistor 14, and a microprocessor 16 supplies square-wave gating pulses to the base of the transistor 14. A flyback diode 18 has its anode connected with the collector of the transistor 14 and the lower end of the coil 12. Flyback pulses, of relatively high voltage, e.g., +180 VDC, pass through the diode 18 to a storage capacitor 20. Another diode 19 between coil 12 and ground charges another capacitor 22. A network formed of capacitors 20 and 22 and a diode 24. The capacitors 20 and 22 are connected in series with the diodes 18 and 24 between the positive and negative rails (+12 and ground) and serve as a voltage doubler. The diode 18 connects between the capacitors 20 and 22, so that flyback voltage across the capacitor 22 builds up towards +360 VDC.

A hysteresis switch arrangement is formed of a gated switching device, e.g., an SCR 26, whose anode is connected to the high end of the capacitors 20, 22, and a zener 28 that is connected between the gate and the anode of the SCR 26. A filter capacitor 30 spans between the cathode and gate of the SCR In this embodiment, the zener has a threshold value of +300 volts, so that the SCR turns on when the flyback voltage reaches that level, and then turns off at some lower voltage when the capacitors 20 and 22 are discharged. In an alternative arrangement, the SCR could be controlled from another output (not shown) from the microprocessor 16. A neon bulb or other negative resistance device could replace the SCR.

An ignition transformer 32 is shown here with its primary winding 34 coupled between the cathode of the SCR 26 and the junction of the capacitor 22 and the diode 24. When the SCR is switched on, the accumulated charge on the capacitive network 20, 22 is dumped through the primary winding at about 300 volts. This produces a high voltage, e.g., 20,000 volts, from the transformer secondary winding 36, which feeds an igniter probe 38 within the gas burner. The high voltage generates an arc that causes the flame to light in the burner. After flame is detected, the microprocessor 16 can change the waveform of the gating pulses to the coil 12, i.e., change the duty cycle, so that the circuit ceases producing a high ignition voltage.

Because the flyback voltage is considerably higher than the 12 volt working DC supply voltage, the stored flyback voltage can be discharged directly into the primary 34 of the ignition transformer 32, and there is no need for an intervening or booster transformer. Also, with the relatively high voltage (300 volts) supplied from the capacitors 20, 22, the turns ratio of the transformer 32 can be kept small. This permits the transformer 32 to be provided at low cost, and yet can be provided with high reliability insulation in the secondary winding 36 so that the risk of inter-turn arcing is minimized.

Figure 2:
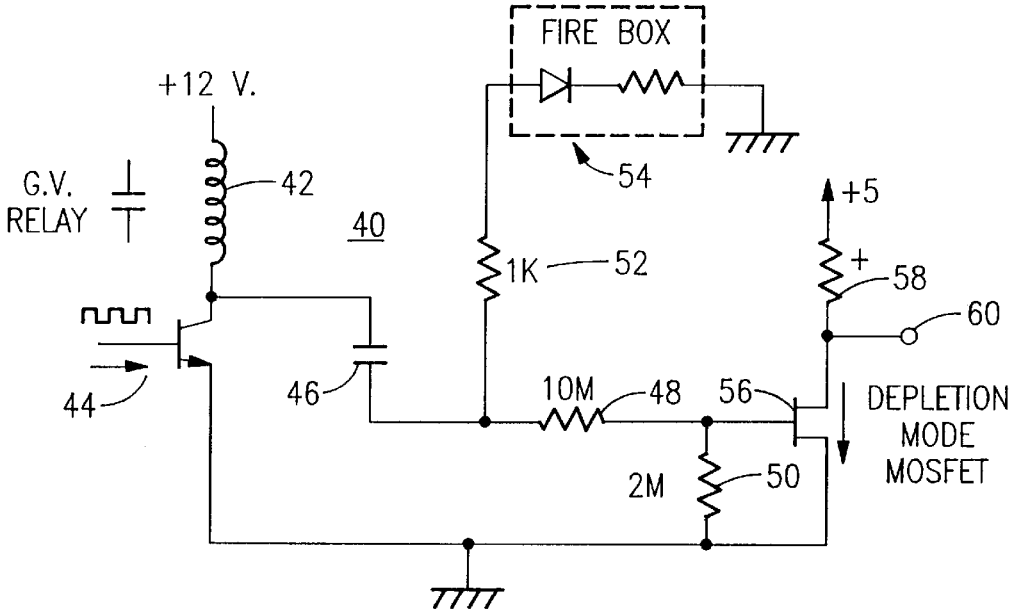
FIG. 2 is a schematic diagram of a rectification flame proving circuit according to an embodiment of this invention.

FIG. 2 schematically illustrates a flame detection circuit or flame proving circuit 40 according to a possible embodiment of this invention. Here a gas valve relay actuator coil 42 is employed, which is also used to actuate the gas valve that supplies a combustible gas to the gas burner (not shown). A switching transistor 44, which receives a square-wave gating signal from the microprocessor 16, interrupts the current flow through the actuator coil 42. A capacitor is connected to the collector electrode of the transistor 44, and derives an AC signal that is fed to a resistive network. This network is formed of a resistor 48 (here with a value of 10 megohms) and a resistor 50 (with a value of 2 megohms). A third resistor 52 has one end connected to the junction of the resistor 48 and capacitor 46 and its other end connected to a flame detection conductor within the burner or firebox 54. In the Drawing, the schematic representation of a diode and resistor in series within the firebox 54 represents the fact that the flame behaves like a diode and resistor, and produce a weak rectified current. A depletion mode MOSFET transistor 56 detects the presence of flame. Here the MOSFET 56 has its source or common terminal connected to ground, and its gate connected to one end of the resistor 48. The other resistor 50 is connected between the gate and source terminals of the MOSFET 56. A load or signal resistor 58 is connected between the drain of the MOSFET 56 and a supply of signal voltage (+5 VDC), with an output terminal 60 being defined by the junction of the load resistor 58 and the MOSFET drain.

The AC signal from the coil 42 is supplied through the resistor 48 to the gate of the transistor 56. However, if flame is present, the capacitor will charge through the rectification conductor in the firebox 54, and this drives the voltage down at the gate of the transistor This means if flame is present, then the depletion mode transistor 56 will change states, and this will oscillate at the frequency of the forcing function at the base of the transistor 44, producing an oscillating change of level at the output electrode 60.

Figure 3:
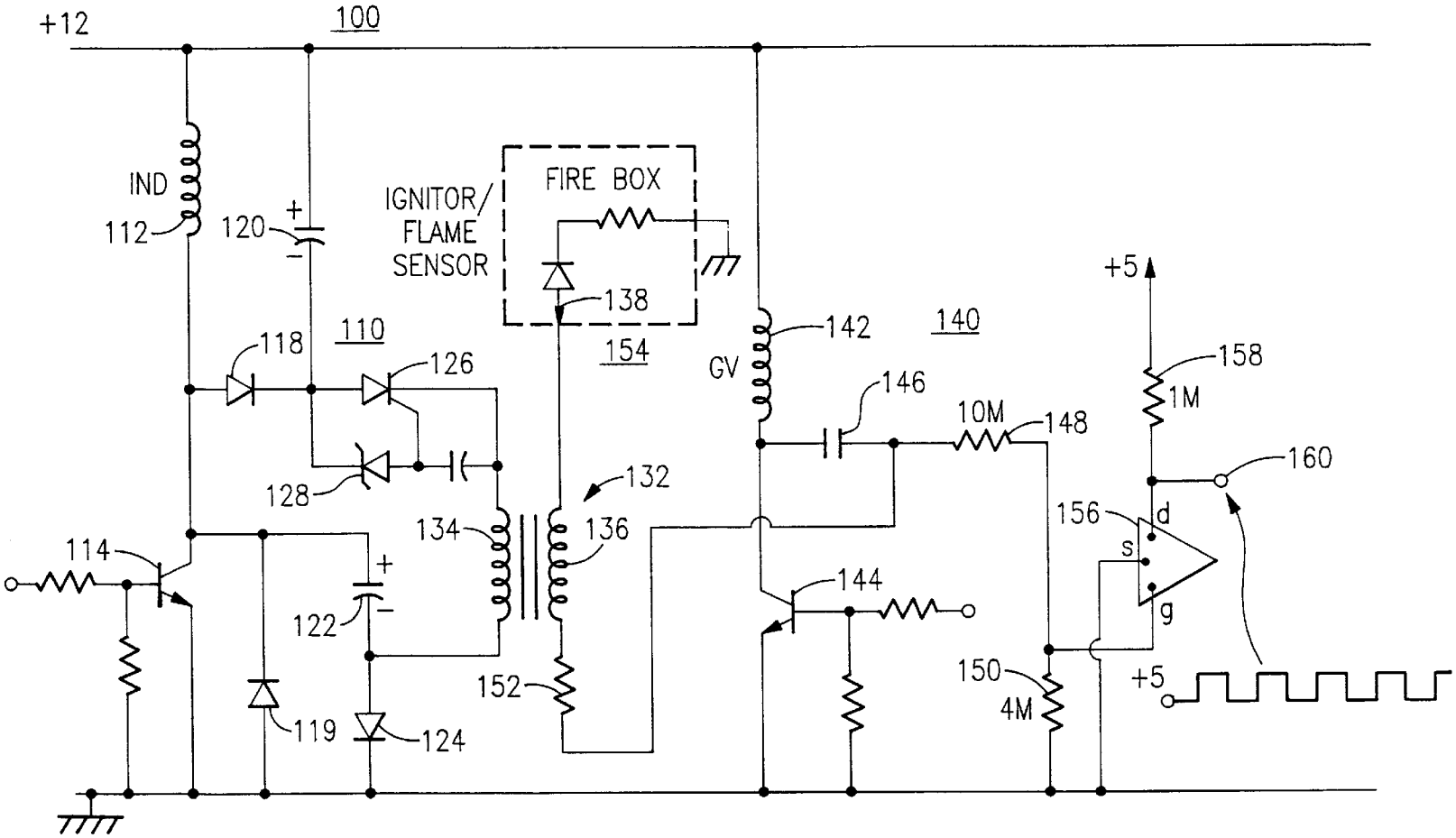
FIG. 3 is a circuit diagram of a combination ignition and flame proving circuit according to an embodiment of this invention.

FIG. 3 illustrates an embodiment of a combined ignition and flame detection 100 circuit of this invention. Here, elements that correspond to elements in the FIG. 1 and FIG. 2 embodiments are identified with the same reference characters, but raised by 100. A detailed description of each of these elements should not be necessary.

The flame ignition portion 110 of the circuit is tied here to the inducer relay coil 112 and the switch transistor 114, with flyback diodes 118 and 119 connected to the transistor end of the coil 112. As in the FIG. 1 embodiment, capacitors 120 and 122 are connected with a diode 124 to form a voltage doubler, and an SCR 126 and zener diode 128 are coupled to form a hysteresis switch. When the flyback voltage stored on the capacitors 120, 122 reaches the voltage defined by the zener 128, the SCR conducts and discharges through the primary winding 134 of the ignition transformer 132. This creates a high ignition voltage on the secondary winding 126 that in turn forms a spark on the ignition probe 138 in the firebox 154.

The rectification flame proving section 140 is tied to the gas valve relay 142 and the associated switching transistor 144. A capacitor 146 is tied to the transistor end of the coil 142, and passes flyback pulses to resistor network formed of resistors 148 and 150. The capacitor 146 also supplies the flyback pulses through a resistor 152 and through the secondary winding 136 of the ignition transformer 132 to the probe 138 within the firebox 154. As is well known, when flame is present in the gas burner, the flame itself acts as a weak rectifier, here represented within the firebox 154 by a diode in series with a resistor to ground. The junction of the resistors 148, 150 is tied to the gate terminal of a depletion mode MOSFET 156. A drain resistor 158 is tied to a source DC voltage (+5 V), and the drain electrode of the MOSFET 156 defines an output electrode 160.

When flame is not present, the flyback pulses do not pass through the flame diode, and so the gate of the depletion mode MOSFET remains high. This produces a steady low at the output terminal 160. On the other hand, when flame is present, there is flame rectification of the flyback pulses, and each occurrence of the flyback pulse will produce a low at the gate of MOSFET 156, resulting in a pulsating signal, as illustrated. This pulsating signal can be easily detected in the microprocessor.

Here, the circuit is implemented with various transistors, resistors, capacitors, and other discrete elements. However, the circuit as shown here could be implemented using a microprocessor to carry out many of the same functions. Also, while the invention has been described for use in connection with low voltage DC environments (i.e., 12 or 24 volts) the invention can be applied in other environments as well.

While the invention has been described here with reference to several preferred embodiments, it should be recognized that the invention is not limited to those precise embodiments. Rather, many modifications and variations will present themselves to persons skilled in the art without departing from the scope and spirit of this invention, as defined in the appended claims.

I claim:

1. Igniter circuit for a furnace gas burner in which an igniter starts a flame in the burner, and in which pulsating current is applied to a coil in order to actuate the furnace; the igniter circuit comprising a flyback rectifier having a first electrode connected to said relay coil and a second electrode;

charge storage means coupled to the second electrode of the flyback rectifier to accumulate a flyback voltage;

a step-up transformer having a primary winding and a secondary winding, the secondary winding being connected to the igniter to provide a high voltage thereto; and switching means coupled between the first charge storage means and the primary winding of the step-up transformer for discharging the accumulated flyback voltage on said charge storage means, including a switching arrangement that automatically discharges said accumulated flyback voltage through said primary winding whenever the flyback voltage reaches a predetermined threshold.

2. Igniter circuit according to claim 1, wherein said first charge storage means includes a first capacitor coupled between the second electrode of said diode and a point of reference voltage.

3. Igniter circuit according to claim 1, wherein said charge storage means includes a pair of capacitors and a diode connected between points of positive and negative voltage.

4. Igniter circuit according to claim 1, wherein switching arrangement includes a hysteresis switching arrangement.

5. Igniter circuit according to claim 4, wherein said hysteresis switching arrangement includes a controlled switching device having main electrodes connected respectively to the second terminal of said diode and to the primary winding of said step-up transformer.

6. Igniter circuit according to claim 5, wherein said controlled switching device includes also a control electrode, and said hysteresis switching arragement further comprises a zener device connected between said control electrode and one of said main electrodes.

7. Rectification flame detection circuit for detecting the presence of flame in a burner of a gas furnace, and in which pulsating current is applied to a relay coil in order to actuate the furnace, the flame detection circuit comprising a capacitor having first and second electrodes, the first electrode being connected to one end of said relay coil;

a transistor having a control electrode, a common electrode and a power electrode, with a signal impedance being connected in series with said power electrode and a junction therebetween defining an output;

a first resistor having one end connected to the second electrode of said capacitor and a another electrode connected to the control electrode of said transistor;

a second resistor connected between the control and common electrodes of said transistor; and a flame detection conductor disposed in said burner and being electrically connected to the one electrode of said first resistor;

such that the output is in one of an oscillating state or non-oscillating state if flame is present, and in the other state if flame is not present in the burner.

8. Rectification flame detection circuit according to claim 7, wherein said transistor includes a depletion mode FET.

9. Rectification flame detection circuit according to claim 7, wherein said relay coil is a solenoid of a gas valve relay.

10. Rectification flame detection circuit according to claim 8, wherein the common electrode of the transistor is a source electrode which is connected to circuit ground.

11. Combination gas burner igniter circuit and rectification flame detection circuit, in which an igniter and flame detection conductor starts a flame and also detects the presence of flame in a burner of a gas furnace, and in which pulsating current signals are applied respectively a first and second relay coils in order to actuate the furnace, the igniter circuit and flame detection circuit comprising a flyback rectifier having a first electrode connected to the first relay coil and a second electrode;

charge storage means coupled to the second electrode of the flyback rectifier to accumulate a flyback voltage;

a step-up transformer having a primary winding and a secondary winding, the secondary winding being connected to the igniter and flame detection conductor to provide a high voltage thereto;

switching means coupled between the charge storage means and the primary winding of the step-up transformer for discharging the charge storage means through the primary winding whenever the stored flyback voltage reaches a suitable level to produce ignition;

a capacitor having first and second electrodes, the first electrode being connected to one end of the second relay coil;

a transistor having a control electrode, a common electrode and a power electrode, with a signal impedance being connected in series with said power electrode and a junction therebetween defining an output;

a first resistor having one end connected to the second electrode of said capacitor and a another end connected to the control electrode of said transistor;

a second resistor connected between the control and common electrodes of said transistor; and one end of said transformer secondary being connected to the one end of said first resistor, so that the igniter and flame detection conductor is connected through said transformer secondary and through said first resistor to said transistor;

such that the output is in one of a first state and a second state if flame is present, and in the other state if flame is not present in the burner.

12. The combination gas burner igniter circuit and rectification flame detection circuit of claim 11, wherein said first state is an oscillating state and said second state is a steady low state.

* * * * *